US008162320B2

(12) United States Patent
Medina et al.

(10) Patent No.: US 8,162,320 B2
(45) Date of Patent: Apr. 24, 2012

(54) ADJUSTABLE TARGET STAND

(75) Inventors: Jose Medina, Piscataway, NJ (US); Arthur G. Randolph, Asbury, NJ (US)

(73) Assignee: Awareness Protective Consultants, LLC, Piscataway, NJ (US)

( * ) Notice: Subject to any disclaimer, the term of this patent is extended or adjusted under 35 U.S.C. 154(b) by 74 days.

(21) Appl. No.: 12/695,994

(22) Filed: Jan. 28, 2010

(65) Prior Publication Data

US 2010/0194048 A1 Aug. 5, 2010

Related U.S. Application Data

(60) Provisional application No. 61/206,361, filed on Jan. 31, 2009.

(51) Int. Cl.
*F41J 1/10* (2006.01)

(52) U.S. Cl. ..... 273/407; 273/410

(58) Field of Classification Search ..... 273/398–410, 273/390–392; 248/158, 160, 161, 162.1, 248/404–418; 211/168, 174, 205, 196, 182, 211/170; 473/476–478, 447, 448
See application file for complete search history.

(56) References Cited

U.S. PATENT DOCUMENTS

| | | | | | |
|---|---|---|---|---|---|
| 2,284,510 | A * | 5/1942 | Cates | 273/407 |
| 2,372,111 | A * | 3/1945 | Norberg | 273/407 |
| 2,538,118 | A * | 1/1951 | Miller | 273/407 |
| 2,550,150 | A * | 4/1951 | Hartley | 224/550 |
| 3,087,701 | A * | 4/1963 | Wallace | 248/166 |
| 4,691,925 | A * | 9/1987 | Scholem | 273/407 |
| 5,209,492 | A * | 5/1993 | Hamilton | 273/407 |
| 5,377,849 | A * | 1/1995 | Martin | 211/85.7 |
| 5,421,586 | A * | 6/1995 | Amram et al. | 273/400 |
| 5,503,356 | A * | 4/1996 | Shelby | 248/170 |
| D376,577 | S * | 12/1996 | Avery | D12/408 |
| 5,584,480 | A * | 12/1996 | Grimsrud | 473/416 |
| 5,676,378 | A * | 10/1997 | West | 273/390 |
| 5,816,579 | A * | 10/1998 | Broussard et al. | 273/408 |
| 5,938,203 | A * | 8/1999 | Beckwith, Sr. | 273/407 |
| 5,947,477 | A * | 9/1999 | Turnipseed | 273/407 |
| 5,967,523 | A * | 10/1999 | Brownlee | 273/407 |
| 6,139,450 | A * | 10/2000 | Rivers | 473/422 |
| 6,398,215 | B1 * | 6/2002 | Carroll | 273/108 |
| 6,435,512 | B1 * | 8/2002 | Beckwith, Sr. | 273/407 |
| 7,083,055 | B1 * | 8/2006 | Ambrosat | 211/85.7 |
| 7,338,048 | B1 * | 3/2008 | Hulstine et al. | 273/407 |
| D634,956 | S * | 3/2011 | St. John | D6/552 |
| 7,946,589 | B2 * | 5/2011 | Duerr | 273/407 |
| 7,959,154 | B2 * | 6/2011 | Ball | 273/407 |
| 2004/0036223 | A1 * | 2/2004 | Wilkus | 273/407 |
| 2005/0067785 | A1 * | 3/2005 | Moore, III | 273/407 |
| 2007/0176369 | A1 * | 8/2007 | Sellke | 273/407 |
| 2007/0238540 | A1 * | 10/2007 | Lin | 473/172 |
| 2010/0116951 | A1 * | 5/2010 | Bifulco | 248/146 |
| 2010/0140874 | A1 * | 6/2010 | Kobett | 273/407 |
| 2011/0074112 | A1 * | 3/2011 | Allen | 273/407 |

* cited by examiner

*Primary Examiner* — Mark Graham
(74) *Attorney, Agent, or Firm* — Patterson & Sheridan, LLP

(57) ABSTRACT

A target stand providing improved adjustability is provided. The target stand is suitable for use in reality-based training methods and may advantageously position a target holder in realistic settings for an improved training experience. The target stand has at least one target holder for securing at least one of a target and/or target trap, may be height adjustable, may support the target holder on flat and non-flat surfaces, and may allow for adjustment of the target holder in at least two axes of rotation.

11 Claims, 6 Drawing Sheets

ADJUSTABLE TARGET STAND

CROSS-REFERENCE TO RELATED APPLICATION

This application claims benefit to U.S. Provisional Application Ser. No. 61/206,361, filed Jan. 31, 2009 by Jose Medina and Arthur G. Randolph, which is incorporated by reference in its entirety.

BACKGROUND OF THE INVENTION

1. Field of the Invention

The present invention generally relates to target stands suitable for use with reality-based methods of target training, as well as shooting skill development through the use of simulation or marking round firearms.

2. Description of the Related Art

Generally, shooting skill development and law enforcement/counter terrorism tactics have advanced through the use of paintball, simulation and marking round weaponry. The use of targets in such activities is a critical component in such activities. However, the limitation on target placement can significantly lessen the benefits of such activities. Those persons involved in such activities need the ability to position targets consistent with behavior that a live person would exhibit, in a rapid fashion without support from walls, string from ceilings, or other means that would reduce the experience of a participant. The use of conventional target stands do not enable these activities to occur in a variety of locations needed to provide a more realistic simulation and more meaningful training experience.

Thus, there is a need for an improved target stand.

SUMMARY OF THE INVENTION

An adjustable target stand suitable for use in reality-based training methods is provided. The target stand may advantageously position a target holder in realistic settings for an improved training experience. The target stand has at least one target holder for securing at least one of a target and/or target trap, may be height adjustable, may support the target holder on flat and non-flat surfaces, and may allow for adjustment of the target holder in at least two axes of rotation.

In one embodiment, an adjustable target stand includes a base, a post, a tee support and a first target holder. The post is coupled to and extends vertically from the base. The post is additionally tiltable relative to the base. The tee support is coupled to the post and rotatable relative to the base. The first target holder is coupled to the tee support.

In another embodiment, an adjustable target stand includes a post extending vertically from a base and a target holder. The base has legs positionable between a horizontal and non-horizontal orientation. The target holder is coupled to an end of the post opposite the base. The target holder is rotatable relative to the base on a first axis and rotatable relative to the base on a second axis In yet another embodiment, an adjustable target stand includes a base, a post, a tee support and a target holder. The base has at least two legs coupled to a cross-member, wherein the legs are rotatable about an axis defined through a center of the cross-member. The post is coupled to and tiltable relative to the base. The post includes at least two sections. A first section of the post is coupled to and extends vertically from the base. The tee support is coupled to the post and rotatable relative to the base. The tee support includes tee-coupling joining the tee support to a section second of the post and a plurality of end members. The first target holder is coupled to the tee support.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures. It is contemplated that elements and features of one embodiment may be beneficially incorporated in other embodiments without further recitation.

It is to be noted, however, that the appended drawings illustrate only exemplary embodiments of this invention and are therefore not to be considered limiting of its scope, for the invention may admit to other equally effective embodiments.

DETAILED DESCRIPTION

Figure 1:
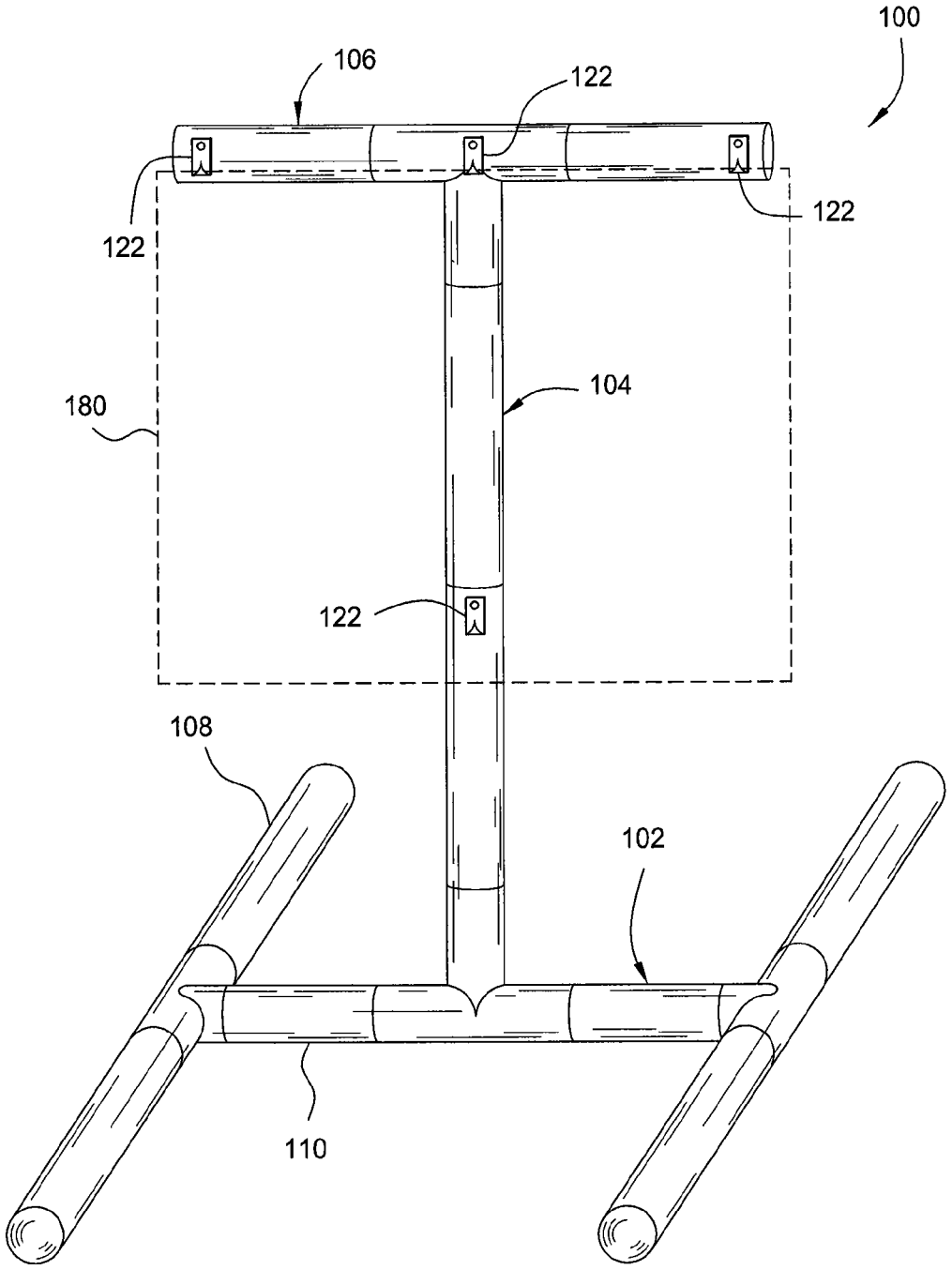
FIG. 1 is a perspective view of one embodiment of a target stand having a base, a post, and a tee support.
Figure 1:
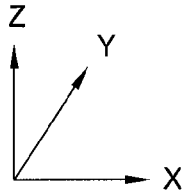

FIG. 1 depicts one embodiment of an adjustable target stand 100 according to one embodiment of the invention. The target stand 100 includes a base 102, a post 104, and a tee support 106. The post 104 is coupled to the base 102 and to the tee support 106. The post 104 generally extends vertically upward from the base 102, and is tiltable relative to the base 102 in at least one vertical plane. The tee support 106 is rotatable relative to the base 102. The tee support 106 and optionally the post 104 include one or more target holders 122 suitable for securing a target and/or target trap (180, shown in phantom) to the target stand. The tiltable post 104 and rotatable tee support 106 allow the target and/or target trap to be readily positioned in a variety of locations thus increasing the effectiveness of the training experience.

The base 102 is suitable for supporting the post 104 and the tee support 106 when placed on the ground, floor, or other surface. The base 102 is also configured to support the post 104 and tee support 106 when placed on a flat surface, an incline, or an uneven surface, such as stairs or rocky terrain. In one embodiment, the base 102 includes a plurality of legs 108 coupled by a cross-member 110. The cross-member 110 may be coupled to the post 104 at a midpoint of the cross-member 110. The cross-member 110 is further coupled to a first leg 108 at a first end 112 of the cross-member 110 and to a second leg 108 at a second end 114 of the cross-member 110. Although the base 102 has an "H" configuration in the embodiment of FIG. 1, it is contemplated that other configurations will be utilized.

The cross-member 110 and the plurality of legs 108 may be coupled together in any number of suitable methods. In one embodiment, the cross-member 110 and legs 108 are coupled together in a manner that allows ease of disassembly for storage and transportation. The cross-member 110 and plurality of legs 108 may also be fitted together in any manner that allows the legs 108 to be rotated in the X-Y plane. In one embodiment, the cross-member 110 and legs 108 may be fit together using a male-female engagement. In one embodiment, the leg 108 may be press or snap fit to cross-member 110.

Figure 2:
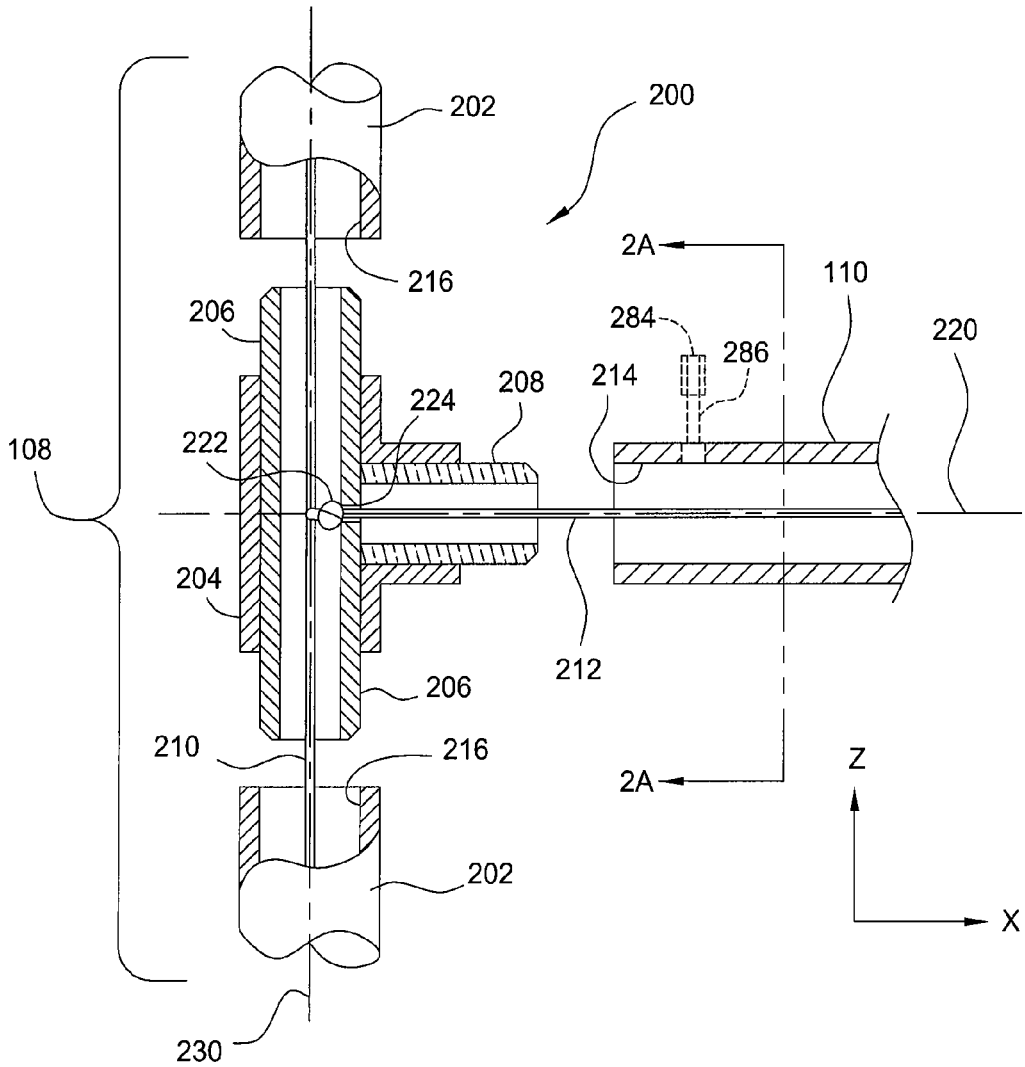
FIG. 2 is an exploded sectional view of one embodiment of a joint coupling component of the base of the target stand.

FIG. 2 depicts one embodiment of a joint 200 between one of the legs 108 with the cross-member 110. The joint 200 allows the leg 108 to rotate about an axis 220 defined through the centerline of the cross-member 110. In one embodiment, the leg 108 may be rotated at least 90-degrees relative to the cross-member 110.

In the embodiment depicted in FIG. 2, the leg 108 comprises two end members 202 and a tee-coupling 204. The tee-coupling 204 includes male couplers 206 and a male coupler 208. The male couplers 206 are configured to engage mating features 216 formed in the end members 202. In the embodiment depicted in FIG. 2, the male couplers 206 may be press fit into mating features 216. In one embodiment, the male coupler 208 is a tube, and the mating feature 216 is the inside diameter of the end member 202. The end members 202 may be secured to the tee-coupling 204 via a press or snap fit of the end members 202 to the tee-coupling 204, or as depicted in FIG. 2, an elastic cord 210 may be secured to each of the end members 202 and routed through the tee-coupling 204 such that when end members 202 are detached from the tee-coupling, the end members 202 may be collapsed against the side of the tee-coupling 204 and retained together for ease of transportation and storage. In one embodiment, end caps (not shown) may be disposed on the distal end of each end member 202.

Similarly, in the embodiment depicted in FIG. 2, the male coupler 208 of the tee-coupling 204 is configured to engage mating feature 214 of the cross-member 110. The cross-member 110 may be secured to the tee-coupling 204 via a press or snap fit of the cross-member 110 to the tee-coupling 204. In one embodiment, an elastic cord 212 may be secured to the tee-couplings 204 on opposing sides of the base 102, and routed through the center of the cross-member 110. In one embodiment, the elastic cord 212 may be secured by a knot 222 tied on the inside of a hole 224 formed in the tee-coupling 204.

Figure 2B:
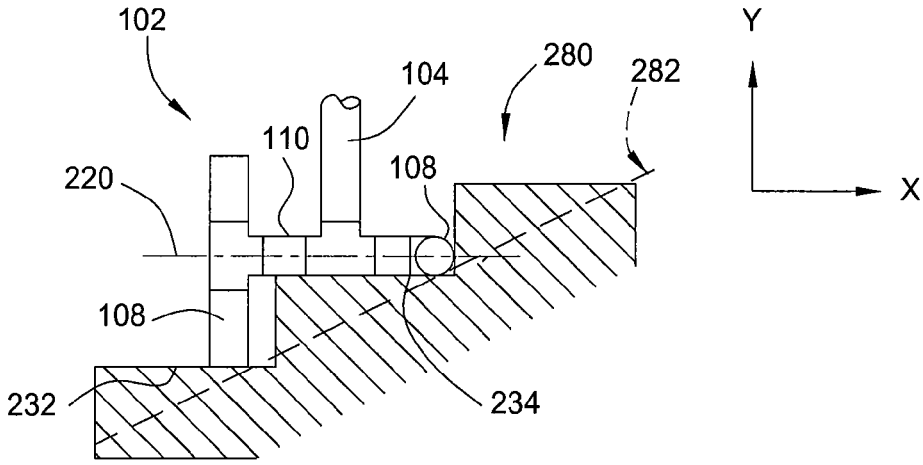
FIG. 2B is a partial, sectional view of the target stand having the base shown deployed on an uneven surface.
Figure 2A:
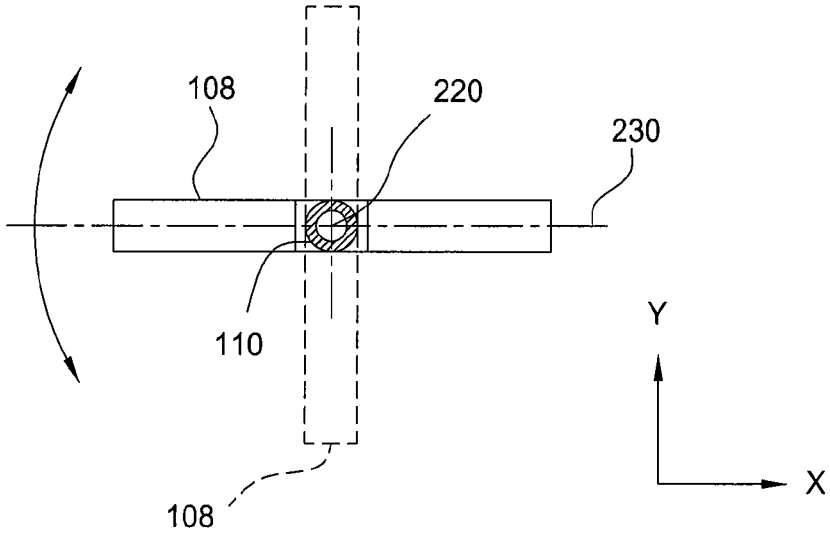
FIG. 2A is a partial, sectional view of one embodiment of the base illustrating rotation of a leg of the base.

The coupling of the male coupler 208 to mating feature 214 permits rotation of the leg 108 along an axis 220 defined by the centerline of cross-member 110. This feature allows the base 102 to be utilized on non-flat surfaces, such as stairs 280 and an incline 282 (shown in phantom), as depicted in FIG. 2B. For example, one leg 108 of the base 102 may be placed on an upper step 234 of the stairs 280 while the other leg 108 may be rotated to set on a lower step 232 of the stairs 280. In another example, the legs 108 may be rotated to follow the incline 282, and the post 104 may be adjusted to a vertical orientation.

Returning to FIG. 2, an optional locking member 284 may be used to selectively secure the orientation between the cross-member 110 and tee-coupling 204. In one embodiment, the optional locking member 284 may engage tee-coupling 204 through a threaded hole 286 formed through the cross-member 110. In one embodiment, the locking member 280 may be a set screw or a knob.

Figure 3:
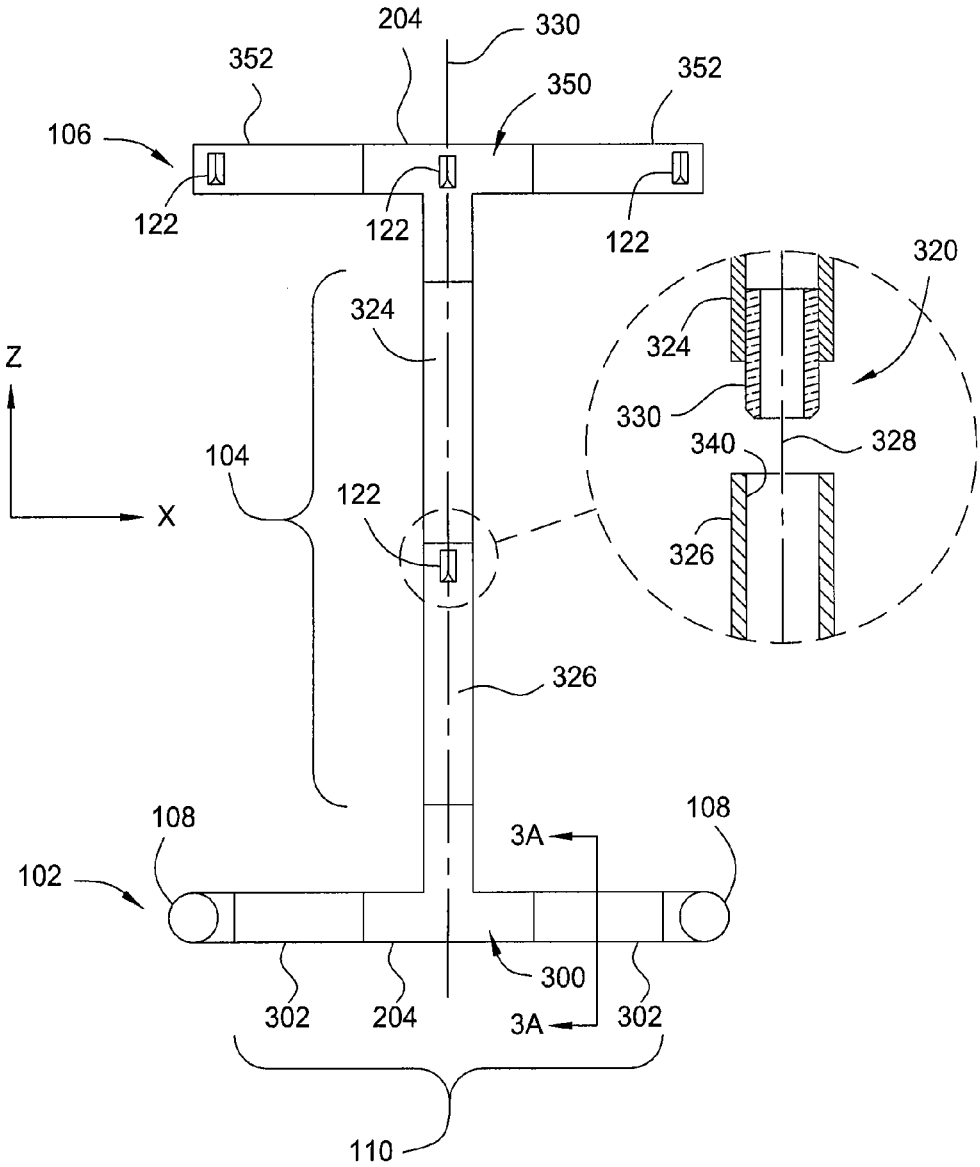
FIG. 3 is a front elevation view of the target stand.

FIG. 3 depicts one embodiment of the post 104, which secures the tee support 102 at a predefined elevation above the base 102. The post 104 comprises at least one section. In the embodiment depicted in FIG. 3, the post 104 comprises a plurality of sections, shown without limitation to number as an upper section 324 and a lower section 326. The upper section 324 is joined to the lower section 326 at a joint 320. In one embodiment, the joint 320 comprises a male coupler 330 secured to the upper section 324 and adapted to engage a mating feature 340 of the lower section 326. In one embodiment, an elastic cord 328 routed through the centerline 330 of the post 104 to axially retain the sections 324, 326 when assembled, and to keep the sections 324, 326 from becoming separated when disassembled.

Figure 3A:
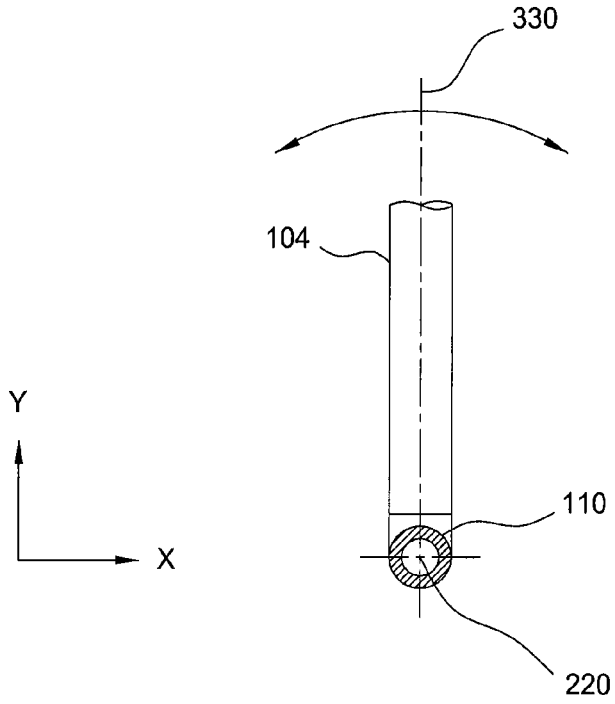
FIG. 3A is a partial sectional view of the target stand illustrating the movement of the post relative to the base.

In one embodiment, the lower section 326 of the post 104 may be coupled to the base 102 via a joint 300. The joint 300 may comprise a tee-coupling 204 joining the lower section 326 to end members 302 of the cross-member 110. The lower section 326 and end members 302 may be coupled to the tee-coupling 204 in a similar manner as that described above with regard to joint 200. The end members 302 may be secured to the tee-coupling 204 via a press or snap fit. In one embodiment, the joint 300 may be configured to permit rotation of the post 104 through an X-Y plane relative to the base 102 about an axis 220 defined through the cross-member 110 as depicted in FIG. 3A. In one embodiment, the joint 300 may be configured to permit 360-degree rotation of the post 104. Alternatively, or in addition to, the post 104 may be tilted in the X-Y plane by rotation of the cross-member 110 relative to the legs 108 via the joint 200. In one embodiment, the post 104 may be tilted to an angle at least 15-degrees from vertical.

Returning to FIG. 3, the upper section 324 of the post 104 may be coupled to the tee support 106 via a joint 350. The joint 350 may comprise a tee-coupling 204 joining the upper section 324 to end members 352 of the tee support 106. The joint 350 is also configured similarly to the joints 200, 300 described above. The end members 352 may be secured to the tee-coupling 204 via a press or snap fit of the end members 352 to the tee-coupling 204. In one embodiment, end caps (not shown) may be disposed on the distal end of each end member 352. In one embodiment, at least one of the joints 300, 320, or 350 is configured to permit rotation of the tee support 106 relative to the base 102 on an axis 330 defined through the post 104 through at least 90-degrees, and in some embodiments up to 360-degrees, of rotation.

The target holders 122 are coupled to the target stand 100 at various locations. The tee support 106 features at least one target holder 122. In one embodiment, a target holder 122 may be disposed on each distal end of the end members 352. Another target holder 122 may be coupled to the joint 350 or portion of the post 104 proximate the tee support 106. The post 104 also features at least one target holder 122. In one embodiment, at least one target holder 122 may be disposed one of the upper or lower sections 324, 326, proximate the mid-point of the post 104.

The post 104 may be configured to reduce the height of the target stand 100. In one embodiment, one of the lower section 326 or the upper section 324 may be removed, and the tee support 106 may be coupled directly to the base 102 using a single section. With the stand at about half the height with one of the sections removed, the target and/or target trap may be readily deployed in a more confined space than could a conventional target stand.

Figure 3B:
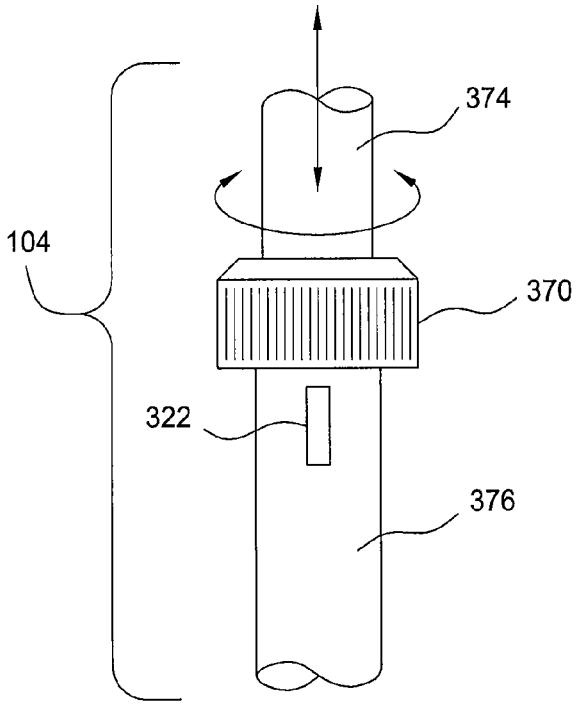
FIG. 3B is a partial sectional view of another embodiment of a post of the target stand.

In another embodiment, depicted in FIG. 3B, the post 104 may be configured to telescope. For example, the upper section 374 may slide axially into the lower section 376. A locking mechanism 370, such as a collet, selectively fixes the upper section 374 relative to the lower section 376 so that the tee support 106 may be set at a desired distance relative to the base 102.

Figure 4:
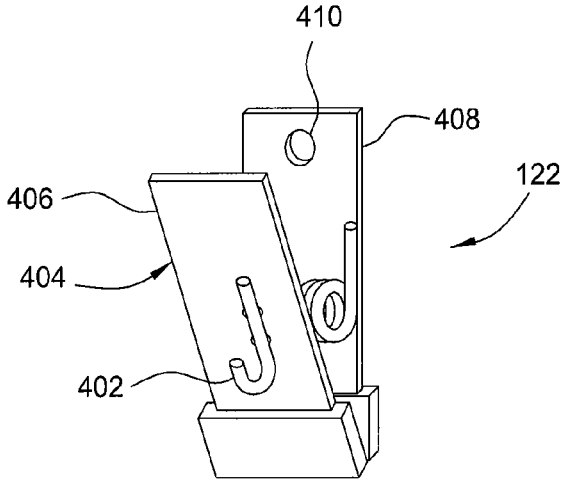
FIG. 4 is a sectional view of one embodiment of a target holder.

FIG. 4 depicts a sectional view of one embodiment of the target holder 122. The target holder 122 is suitable for affixing a target and/or a target trap to the target stand 100. The target holder 122 may be coupled to the post 104 by any suitable means, for example, by screws, rivets, or other fasteners. In one embodiment, the target holder 122 includes a hook 402 coupled to a clamp 404. The hook 402 is adapted to suspend a target or target trap by, for example, engaging a hole in the target or target trap. The clamp 404 includes spring-loaded jaws 406, 408 adapted to engage and retain the target and/or target trap. The jaw 408 not having the hook 402 includes one or more holes 410 for securing the target holder 122 to the post 104 or the tee support 106.

Thus a target stand has been disclosed which allows a target and/or target trap to be positioned in a variety of locations. The target stand is light weight and easily transported. Moreover, the target stand may be readily and rapidly adapted to position a target on a wide variety of flat, rough, horizontal and non-horizontal, non-planar surfaces when enhancing the training experience, thereby improving the readiness of law enforcement and counter-terrorism professionals.

Although various embodiments which incorporate the teachings of the present invention have been shown and described in detail herein, those skilled in the art can readily devise many other varied embodiment that still incorporate these teachings.

What is claimed is:

1. An adjustable target stand, comprising:

a base comprising:

a cross-member; and at least two legs coupled to the cross-member, the legs rotatable about an axis through a center of the cross-member;

a post comprising at least a lower section coupled to and extending vertically from the base, and an upper section coupled to a tee support, the lower section removably coupling with the upper section, the post further comprising a locking mechanism selectively fixing the upper section relative to the lower section such that the upper section may be set at a desired distance relative to the base;

the tee support coupled to the base by the post; and a first target holder and a second target holder coupled to the tee support, the target holders disposed on opposite ends of the tee support; and a target trap removably supported by the target holders.

2. The target stand of claim 1, wherein the base further comprises an elastic cord disposed through the cross-member.

3. The target stand of claim 1, wherein the post further comprises an elastic cord disposed through the base.

4. The target stand of claim 1, wherein the tee support further comprises an elastic cord disposed through the tee support.

5. The target stand of claim 1, further comprising an elastic cord disposed through at least one of the cross-member, the base, and the tee support.

6. The target stand of claim 1, wherein each of the of the target holders disposed on the tee support further comprises:

a spring jaw and a hook.

7. A target stand comprising:

a base having legs positionable between a horizontal and non-horizontal orientation;

a post having a vertically adjustable height, the post extending vertically from the base, the post comprising a lower section removably coupling with a upper section, the post further comprising a locking mechanism selectively fixing the upper section relative to the lower section;

a post target holder coupled to an end of the post opposite the base;

a tee-support coupled to the post;

a first target holder and a second target holder coupled to opposite ends of the tee support, the target holders having a spring jaw and a hook suitable for securing a target trap to the tee support; and a target trap coupled to at least one of the spring jaw and hook of the target holders disposed on the tee support.

8. The target stand of claim 7, wherein the post comprises:

a plurality of axially coupled sections which may be disassembled for transporting.

9. The target stand of claim 7 wherein the tee-support is rotatable about at least one of the post and base about a first axis, the first axis extending through the post.

10. The target stand of claim 9, wherein the tee-support is rotatable relative to the base about a second, the second axis disposed at a right angle to the first axis.

11. The target stand of claim 10, wherein the second axis is disposed at a right angle to the first axis, and one of the legs rotates on the second axis.

* * * * *